US009472871B2

(12) United States Patent
Lin et al.

(10) Patent No.: US 9,472,871 B2
(45) Date of Patent: Oct. 18, 2016

(54) WIRE TERMINAL CONNECTOR

(71) Applicant: Excel Cell Electronic Co., Ltd., Taichung (TW)

(72) Inventors: Chih-Ming Lin, Taichung (TW); Lee-Yen Sun, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 14/850,117

(22) Filed: Sep. 10, 2015

(65) Prior Publication Data

US 2016/0099528 A1 Apr. 7, 2016

(30) Foreign Application Priority Data

Oct. 3, 2014 (TW) ..... 103134606 A

(51) Int. Cl.
*H01R 12/53* (2011.01)
*H01R 4/48* (2006.01)

(52) U.S. Cl.
CPC ..... *H01R 12/53* (2013.01); *H01R 4/4836* (2013.01)

(58) Field of Classification Search
CPC H01R 4/4818; H01R 4/4845; H01R 4/4836; H01R 4/4817; H01R 13/4827; H01R 4/26
USPC ..... 439/441, 438, 440, 442, 725, 730, 835, 439/552, 555, 588, 589, 851, 852, 854, 855, 439/882, 867, 739
See application file for complete search history.

(56) References Cited

U.S. PATENT DOCUMENTS 5,019,674 A * 5/1991 Greene ..... H01R 4/2433 174/84 C
5,454,730 A * 10/1995 Tozuka ..... H01R 4/4818 439/438

(Continued)

FOREIGN PATENT DOCUMENTS

| | | |
|---|---|---|
| CN | 201590632 U | 9/2010 |
| CN | 102782940 A | 11/2012 |
| TW | M383849 U1 | 7/2010 |

OTHER PUBLICATIONS

TW Search report in corresponding TW patent application No. 103134606 dated Apr. 13, 2016 (2 pages).

*Primary Examiner* — Abdullah Riyami
*Assistant Examiner* — Harshad Patel
(74) *Attorney, Agent, or Firm* — Trop Pruner & Hu, P.C.

(57) ABSTRACT

A wire terminal connector includes a terminal member having a base panel, two resilient clamp plates that project from the base panel for clamping a wire conductor therebetween, and a stop plate that projects from the base panel and extends transversely of the clamp plates for abutting against one end of the wire conductor, and an insulative housing having a receiving space, a first open end that permits the terminal member to enter and to be disposed in the receiving space, and a second open end that is opposite to the first open end and that is adapted for the wire conductor to enter the receiving space.

13 Claims, 12 Drawing Sheets

(56) References Cited

U.S. PATENT DOCUMENTS 7,150,646 B2 * 12/2006 Trumper ..... H01R 4/4818 439/441
8,262,405 B1 * 9/2012 Bishop ..... H01R 4/4845 439/439
8,328,586 B2 * 12/2012 Bies ..... H01R 12/53 439/725
8,721,376 B1 * 5/2014 Bishop ..... H01R 12/57 439/441
9,306,297 B2 * 4/2016 Bishop ..... H01R 4/4818 439/856
2007/0249215 A1 * 10/2007 Osborn ..... H01R 11/05 439/441
2008/0311802 A1 * 12/2008 Keswani ..... H01R 4/4818 439/863
2013/0029529 A1 * 1/2013 Osagie ..... H01R 4/4818 439/625
2014/0242833 A1 * 8/2014 Mostoller ..... H01R 4/4836 439/438

* cited by examiner

WIRE TERMINAL CONNECTOR

CROSS-REFERENCE TO RELATED APPLICATION

This application claims priority of Taiwanese Application No. 103134606, filed on Oct. 3, 2014.

FIELD OF THE INVENTION

The invention relates to a wire terminal connector, more particularly to a wire terminal connector for connecting a wire conductor.

BACKGROUND OF THE INVENTION

Electrical connection between electric components is generally achieved through the use of wire conductors. Conventional methods of making this connection involve welding or screwing the wire conductors to the electric components, both of which are less than convenient in application. Furthermore, different-sized electric components also require different-sized wire conductors to be coupled therewith, putting a restriction on the size of the wire conductors. These inconveniences seem to suggest that the conventional methods of electrically connecting electrical components through wire conductors could be improved.

SUMMARY OF THE INVENTION

Therefore, the object of the present invention is to provide a wire terminal connector that can alleviate at least one of the aforesaid drawbacks of the prior art.

According to one aspect of the present invention, a wire terminal connector may include a terminal member having a base panel, two resilient clamp plates that project from the base panel for clamping a wire conductor therebetween, and a stop plate that projects from the base panel and extends transversely of the clamp plates for abutting against one end of the wire conductor, and an insulative housing having a receiving space, a first open end that permits the terminal member to enter and to be disposed in the receiving space, and a second open end that is opposite to the first open end and that is adapted for the wire conductor to enter the receiving space.

According to another aspect of the present invention, a wire terminal connector may include a terminal member having a base panel, two resilient clamp plates that project from the base panel for clamping the wire conductor therebetween, and an insulative housing having a receiving space, a tongue plate, a first open end that permits the terminal member to enter and to be disposed in the receiving space, and a second open end that is opposite to the first open end and that is adapted for the wire conductor to enter the receiving space. Each of the clamp plates has a clamping part for clamping the wire conductor, and a release part that is formed on the clamping part to enable the clamping part to move away from the wire conductor. The tongue plate is proximal to the release part and is operable to push the release part of each of the clamp plates and to thereby move the clamping part of each of the clamp plates away from the wire conductor.

The effect of the present invention is that, by virtue of the two resilient clamp plates, a user need only insert the wire conductor through the second open end into the wire terminal connector to complete installation thereof. In addition, the two resilient clamp plates are capable of clamping wire conductors of any size between 18 to 24 American Wire Gauge (AWG), enabling better compatibility and allowing a wider choice of wire conductors for the user.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
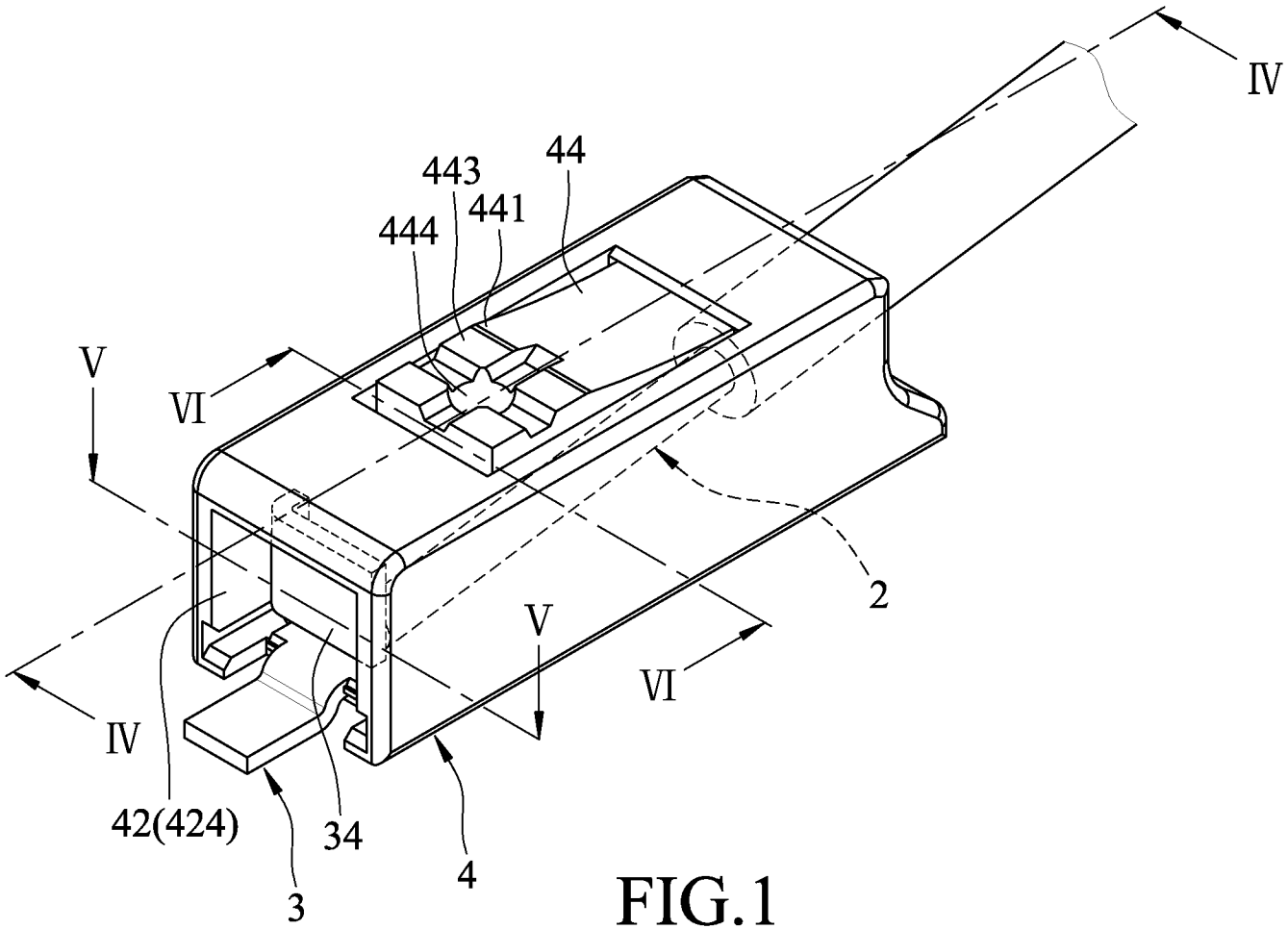
FIG. 1 is an assembled perspective view of a first embodiment of a wire terminal connecter according to the invention.

Before the present invention is described in greater detail, it should be noted that like elements are denoted by the same reference numerals throughout the disclosure.

Figure 2:
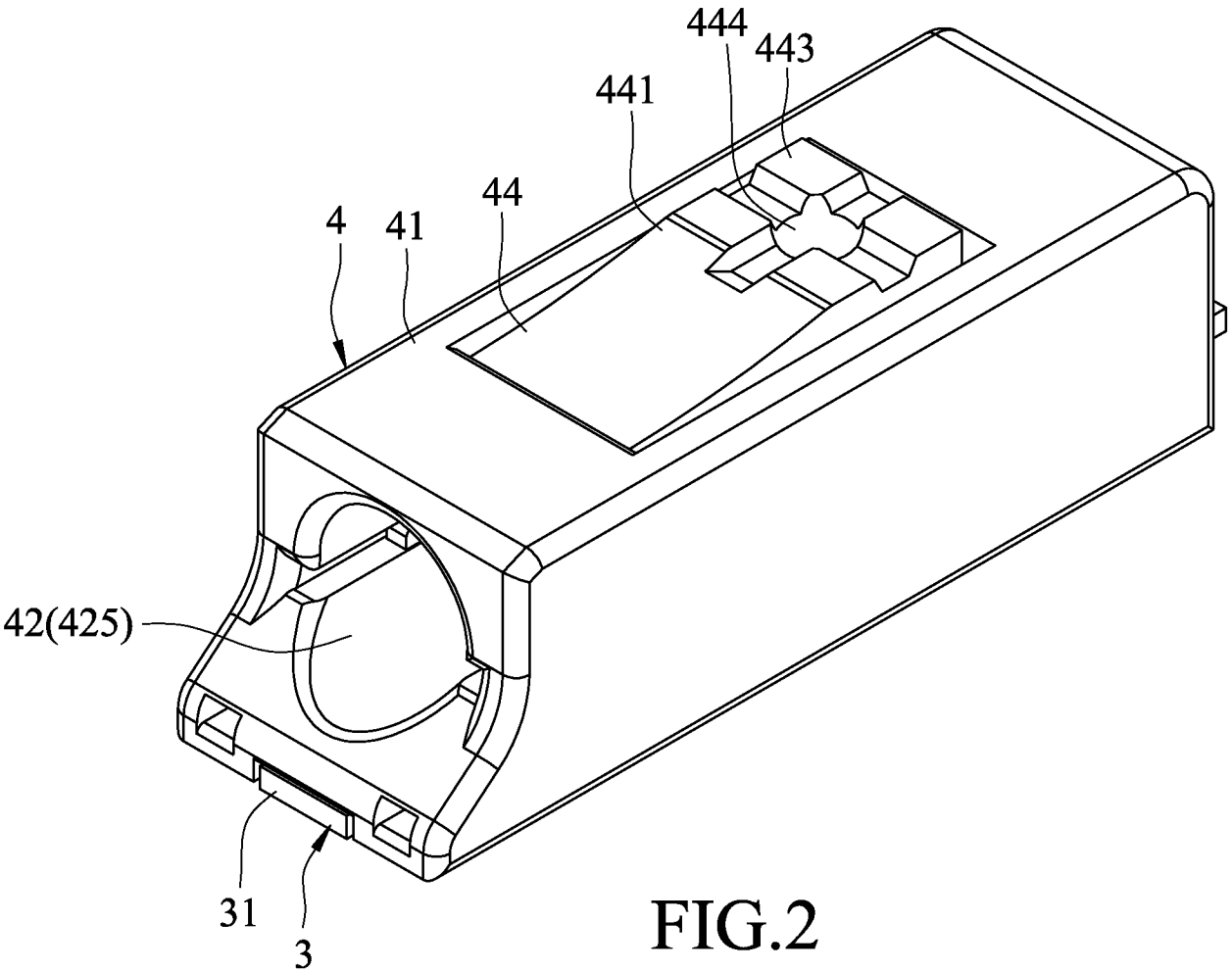
FIG. 2 is a perspective view of the first embodiment showing a second open end of the wire terminal connector.

Referring to FIGS. 1 and 2, a first embodiment of a wire terminal connector according to the present invention is adapted for connecting a wire conductor 2. The wire terminal connector of this embodiment includes a terminal member 3 and an insulative housing 4.

Figure 3:
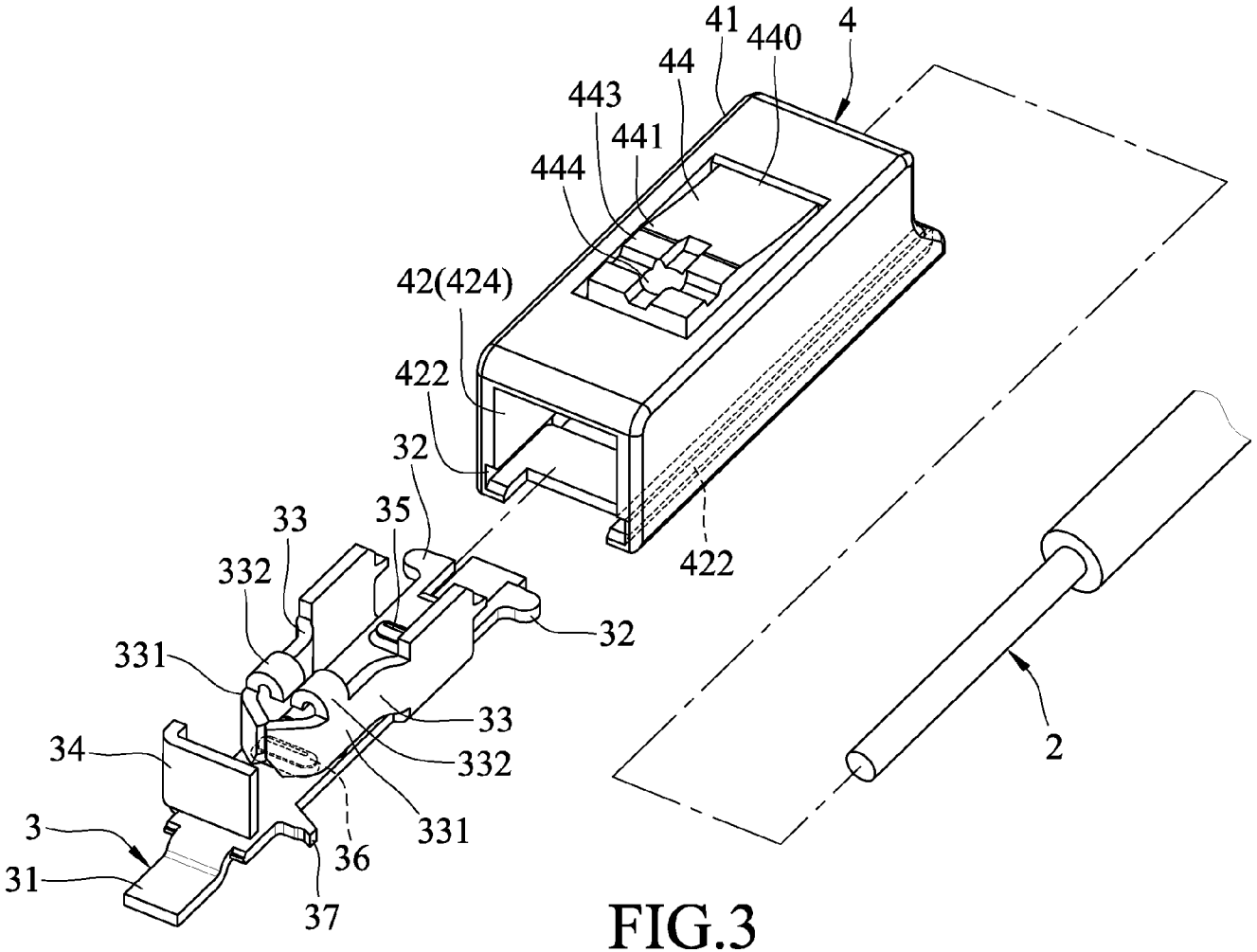
FIG. 3 is an exploded perspective view of the first embodiment.
Figure 4:
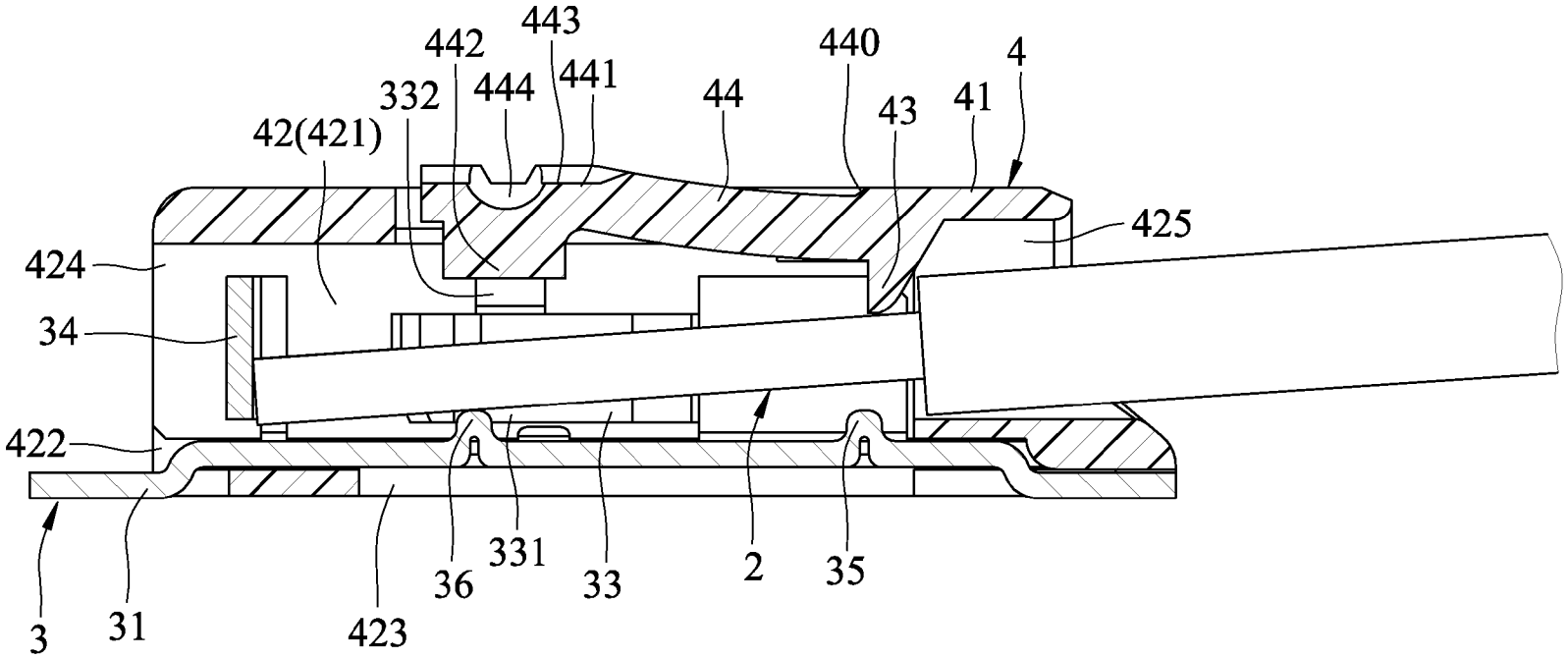
FIG. 4 is a partly sectional view of the first embodiment taken along line IV-IV of FIG. 1 illustrating the wire terminal connector when inserted with a wire conductor.

Referring to FIGS. 3 and 4, in this embodiment, the terminal member 3 is made of metal, and includes a board-shaped base panel 31, two resilient clamp plates 33 that project from the base panel 31 for clamping the wire conductor 2 therebetween, a stop plate 34 that is spaced apart from the clamp plates 33 and that projects from the base panel 31 and extends transversely of the clamp plates 33 for abutting against one end of the wire conductor 2, two guided parts 32, two engaging parts 37 (only one is shown), a first panel protrusion 35 and a second panel protrusion 36.

Each of the two clamp plates 33 has a clamping part 331 for clamping the wire conductor 2, and a release part 332 formed on the clamping part 331 to enable the clamping part 331 to move away from the wire conductor 2. The clamping parts 331 of the clamp plates 33 respectively have clamping ends that extend toward each other, and top ends that are opposite to the base panel 31. The release parts 332 of the clamp plates 33 are spaced apart from the clamping ends of the clamping parts 331 and are respectively formed on the top ends of the clamping parts 331, extending upwardly and respectively therefrom and bending archedly toward each other to come in resilient contact with each other.

The engaging parts 37 each have a sharp end and are disposed respectively on opposite lateral sides of the base panel 31 in proximity to the stop plate 34. The guided parts 32 are disposed respectively on opposite lateral sides of the base panel 31 distally from the engaging parts 37. Each of the guided parts 32 has a protruding length from a respective one of the lateral sides of the base panel 31 and are shorter than that of a respective one of the engaging parts 37.

In this embodiment, the insulative housing 4 is made of plastic, and includes a housing body 41, a receiving groove 42, a guiding part 43 and a tongue plate 44.

The receiving groove 42 is defined by the housing body 41 and has a receiving space 421, two fitting portions 422, a hollow portion 423, and first and second open ends 424, 425 which spatially communicate the receiving space 421 with the exterior environment. The first open end 424 permits the terminal member 3 to enter and to be disposed in the receiving space 421; the second open end 425 is opposite to the first open end 424 and is adapted for the wire conductor 2 to enter the receiving space 421. The two fitting portions 422 are disposed respectively on opposite side walls of the housing body 41 and guide the movement of the guided parts 32 of the terminal member 3 as the terminal member 3 enters the receiving space 421. The engaging parts 37 of the terminal member 3 respectively engage with inner walls of the fitting portions 422 as the terminal member 3 enters further into the receiving space 421 so that the terminal member 3 is secured in the receiving space 421. The hollow portion 423 extends downward from the receiving space 421 through the housing body 41 to provide heat dissipation for the terminal member 3.

The guiding part 43 is connected to a top wall of the housing body 41, extends into the receiving groove 42 in proximity to the second open end 425, and guides the wire conductor 2 as the wire conductor 2 enters the receiving groove 42.

The tongue plate 44 is disposed above and in proximity to the release parts 332 and has a fixed end 440 that is fixed to the top wall of the housing body 41, a free end 441 that is in proximity with the release part 332 and that is opposite to the fixed end 440, a force-application part 443 that is connected to the free end 441 oppositely of the fixed end 440, and a tongue protrusion 442 that protrudes from the force-application part 443 downwardly into the receiving space 421 and that may be disposed at a position opposite to and apart from the release parts 332, which allows the release parts 332 to contact each other, or that may be operated to be at a position between the release parts 332, which pushes the release parts 332 away from each other. The force-application part 443 has a depressed center and a cross-shaped groove 444 for insertion of a screwdriver to apply force thereon.

The first panel protrusion 35 projects from the base panel 31 and is disposed between the two clamp plates 33 in proximity to the second open end 425 for contacting the wire conductor 2. The second panel protrusion 36 also projects from the base panel 31 and is disposed between the first panel protrusion 35 and the stop face 34 for contact with the wire conductor 2.

Figure 5:
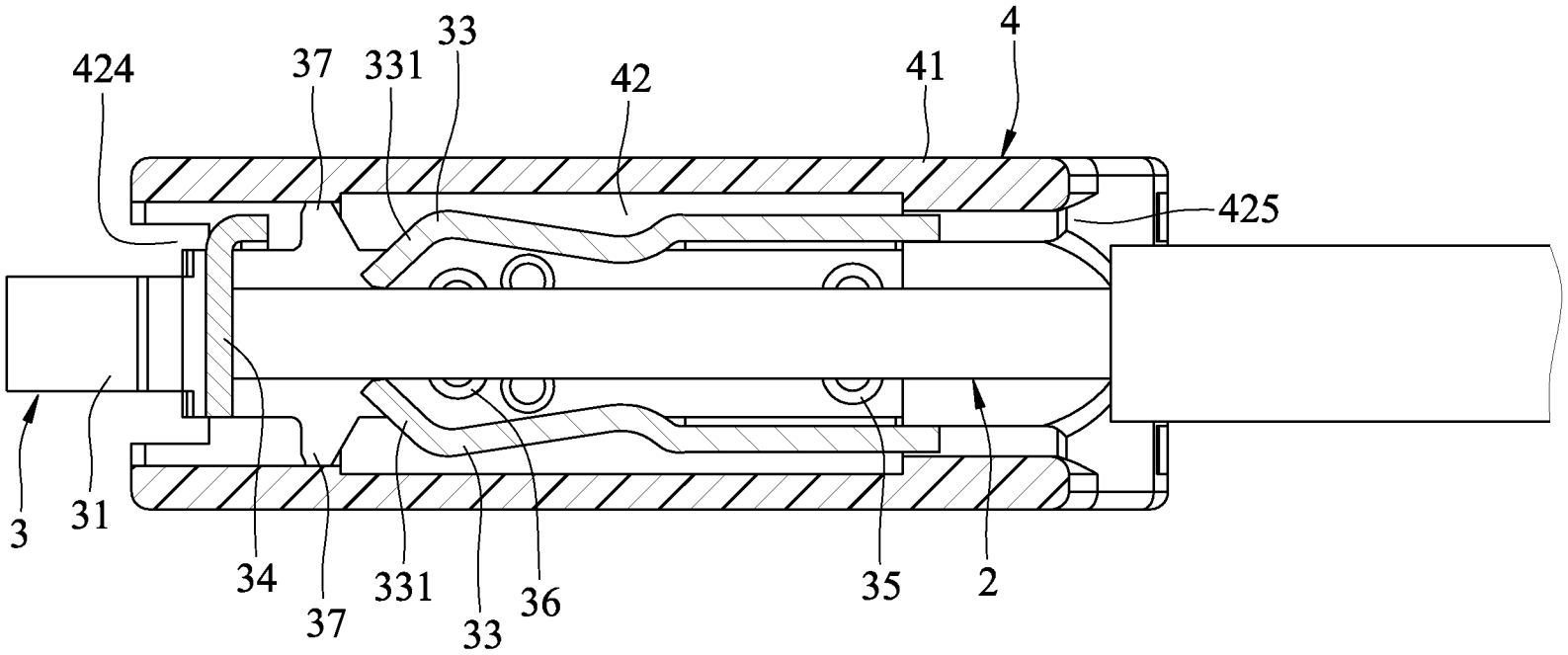
FIG. 5 is a fragmentary sectional view of the first embodiment taken along line V-V of FIG. 1 illustrating two clamp plates clamping the wire conductor therebetween.
Figure 6:
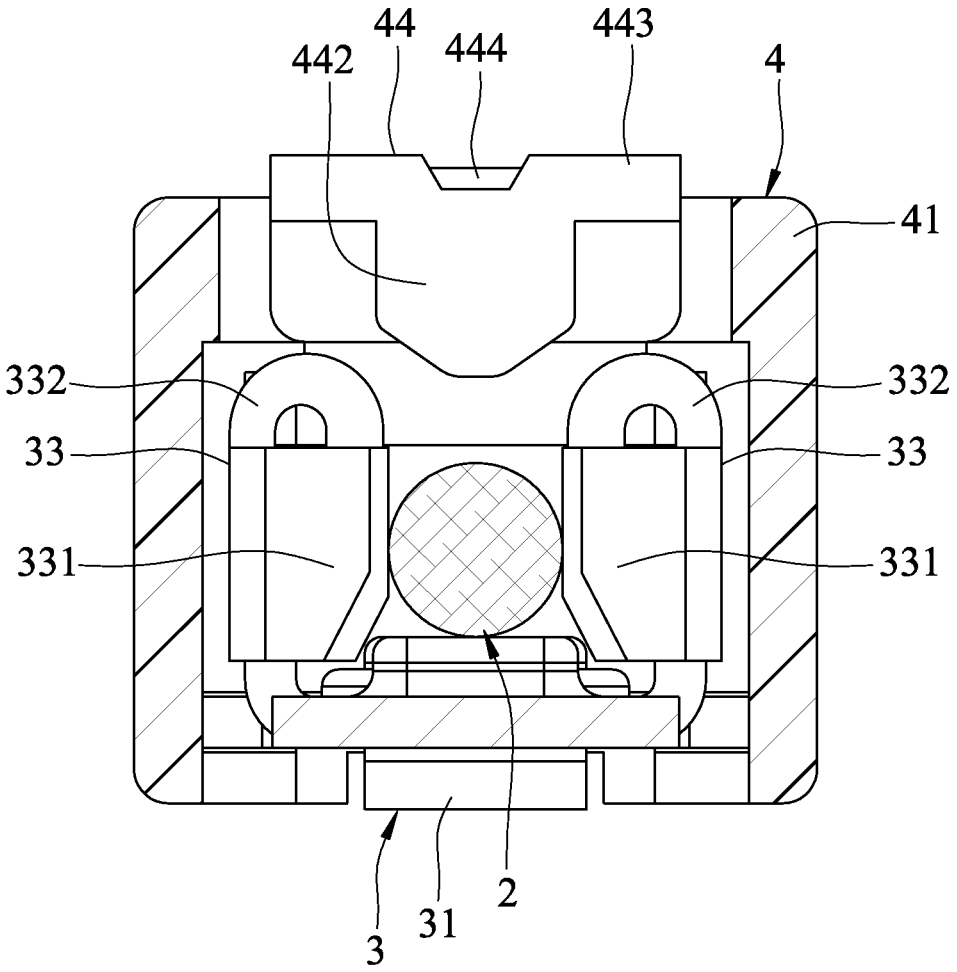
FIG. 6 is a partly sectional view of the first embodiment taken along line VI-VI of FIG. 1, illustrating the situation where the two clamp plates clamp the wire conductor before a tongue plate is pushed down.
Figure 7:
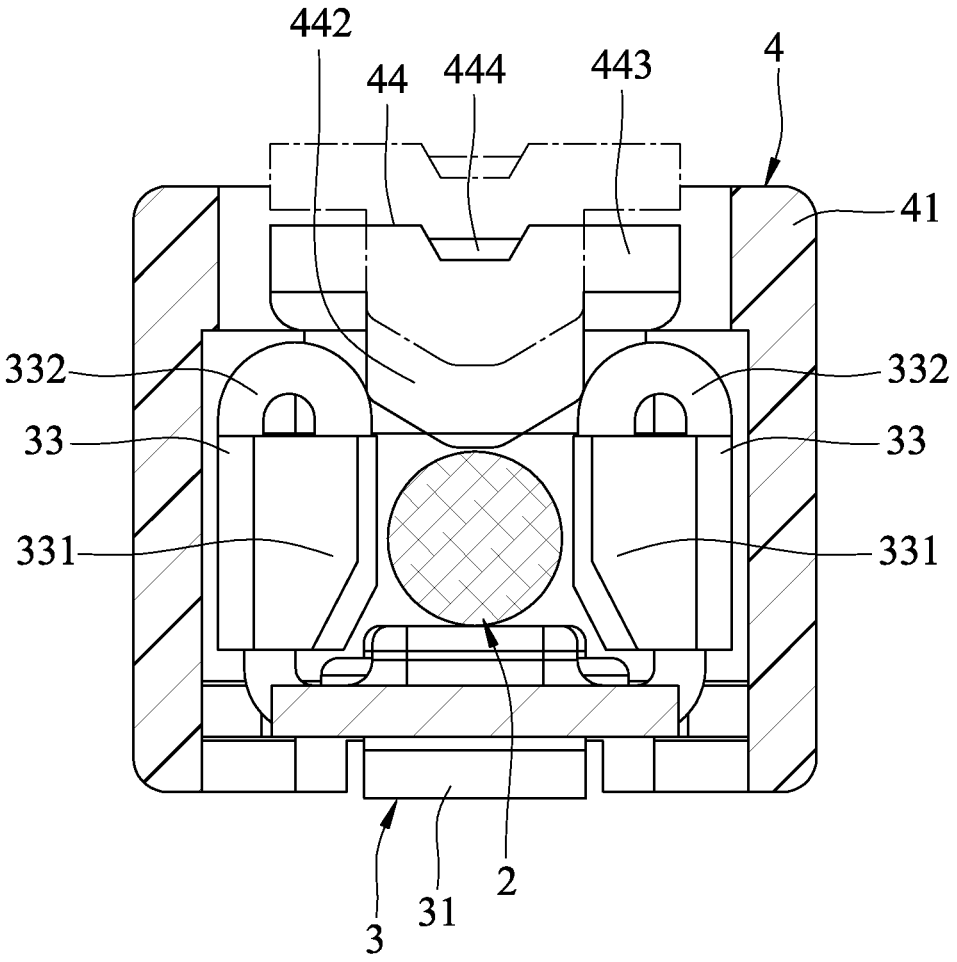
FIG. 7 is a partly sectional view illustrating the situation where the two clamp plates are moved away from the wire conductor after the tongue plate is pushed down.
Figure 8:
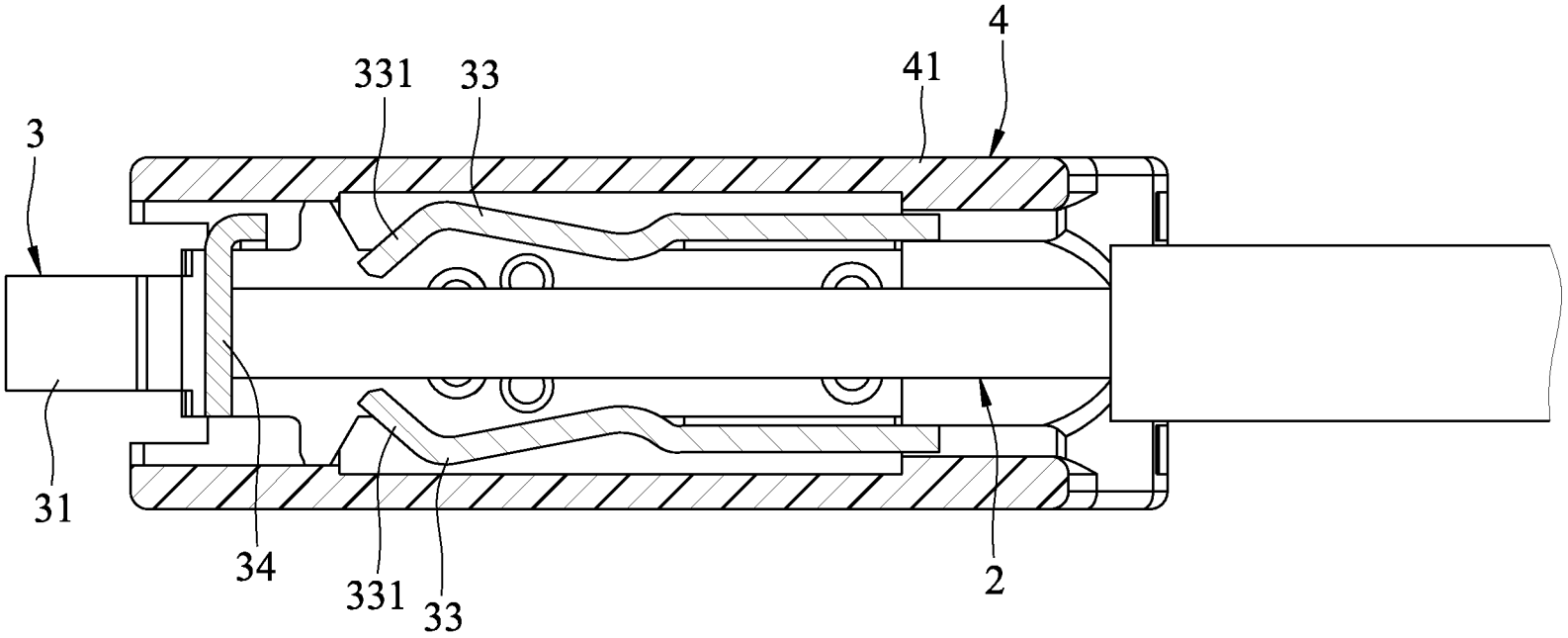
FIG. 8 is a fragmentary and partly sectional view illustrating the two clamp plates having released the hold on the wire conductor.

Referring to FIGS. 4, 5 and 6, the wire conductor 2 is inserted through the second open end 425 of the insulative housing 4 into the receiving space 421 and guided by the guiding part 43. The wire conductor 2 is further pushed to pass between the clamp plates 33 and comes to a stop against the stop face 34. The wire conductor 2 is thus clamped by the clamp plates 33 and prevented from thrusting through the insulative housing 4 by the stop face 34. Once the wire conductor 2 is in place, the terminal member 3 can be electrically connected to an electric component, such as, but not limited to, an LED lamp (not shown), from the end closer to the stop face 34. Referring to FIGS. 7 and 8, to remove the wire conductor 2 from the wire terminal connector, the force-application part 443 is pressed down by, e.g., pushing down the crossed-shaped groove with a screwdriver (not shown) so as to apply pressure on the tongue plate 44. This causes the free end 441 (see FIG. 4) and the tongue protrusion 442 of the tongue plate 44 to move downward, the latter of which wedges between the release parts 332 of the clamp plates 33 to push the release parts 332 apart and move the clamping parts 331 away from each other, thereby releasing the hold of the clamping parts 331 on the wire conductor 2. The the wire conductor 2 may be simply pulled back out from the wire terminal connector through the second open end 425 (see FIG. 4) of the insulative housing 4.

Figure 9:
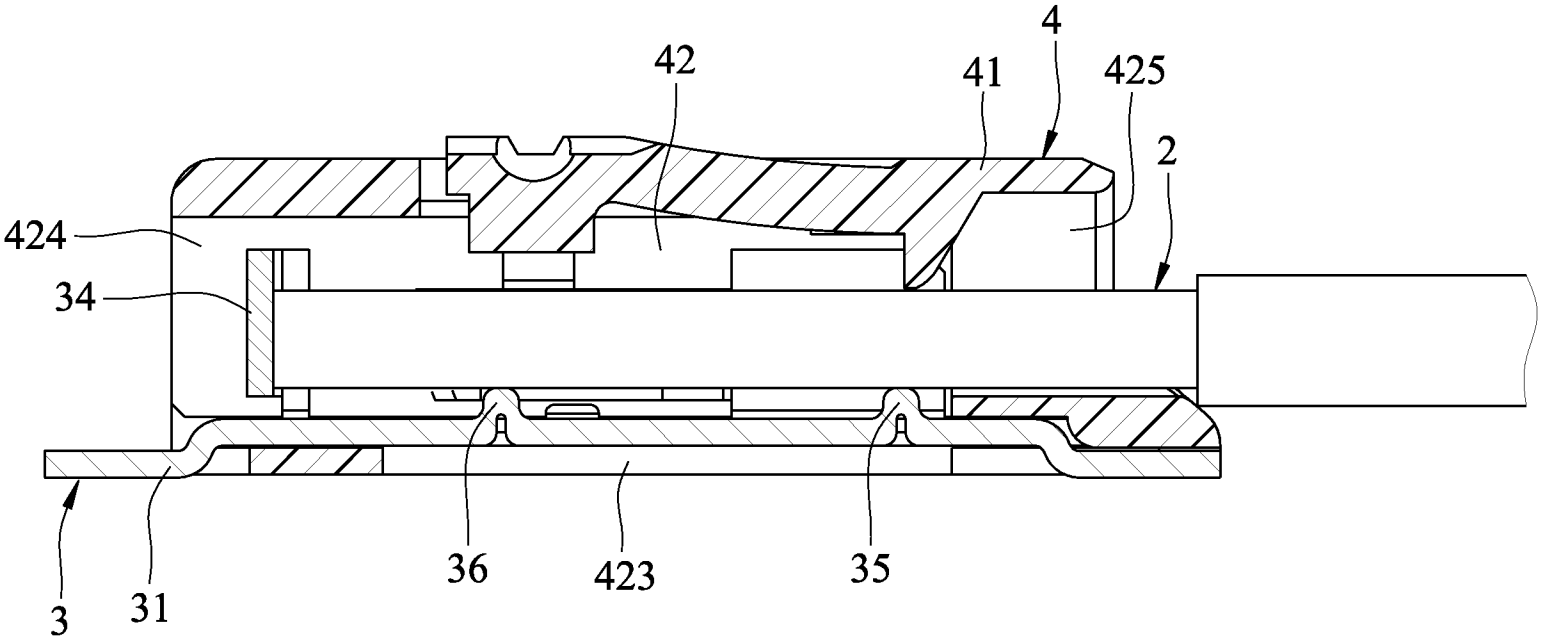
FIG. 9 is a fragmentary and partly sectional view similar to FIG. 4, but illustrating the wire terminal connector when inserted with a wire conductor that is larger in size.

Referring to FIG. 9, the embodiment also permits entry of a wire conductor 2 of larger size, such as one of AWG. The method of inserting and removing a larger-sized wire conductor 2 is no different from that disclosed above and will be omitted from mention herein. It should be noted that, both the first and second panel protrusions 35, 36 would be in contact with the wire conductor 2 of larger size. Increasing the area of contact between the wire conductor 2 and the terminal member 3 allows more heat to transfer from the wire conductor 2 to the terminal member 3 and dissipate through the hollow portion 423 of the insulative housing 4.

Figure 10:
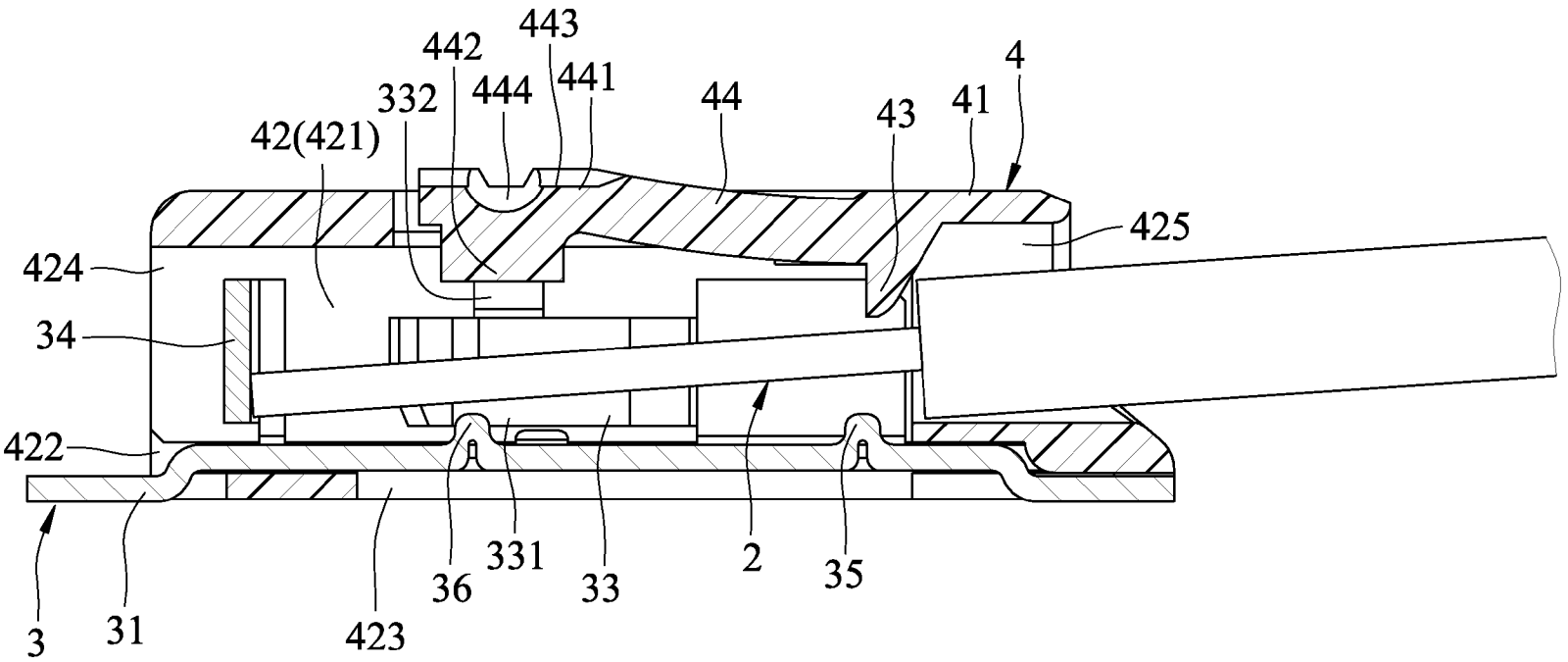
FIG. 10 is a fragmentary and partly sectional view similar to FIG. 4, but illustrating the wire terminal connector when inserted with a wire conductor that is smaller in size.

Referring to FIG. 10, the embodiment also accommodates entry of a wire conductor 2 of smaller size, such as one of 24 AWG, and only the second panel protrusion 36 of the terminal member 3 is in contact with the wire conductor 2 of smaller size. The method of inserting and removing a smaller-sized wire conductor 2 is the same as that for inserting and removing a wire conductor of any other size, and will be omitted from mention herein.

Figure 11:
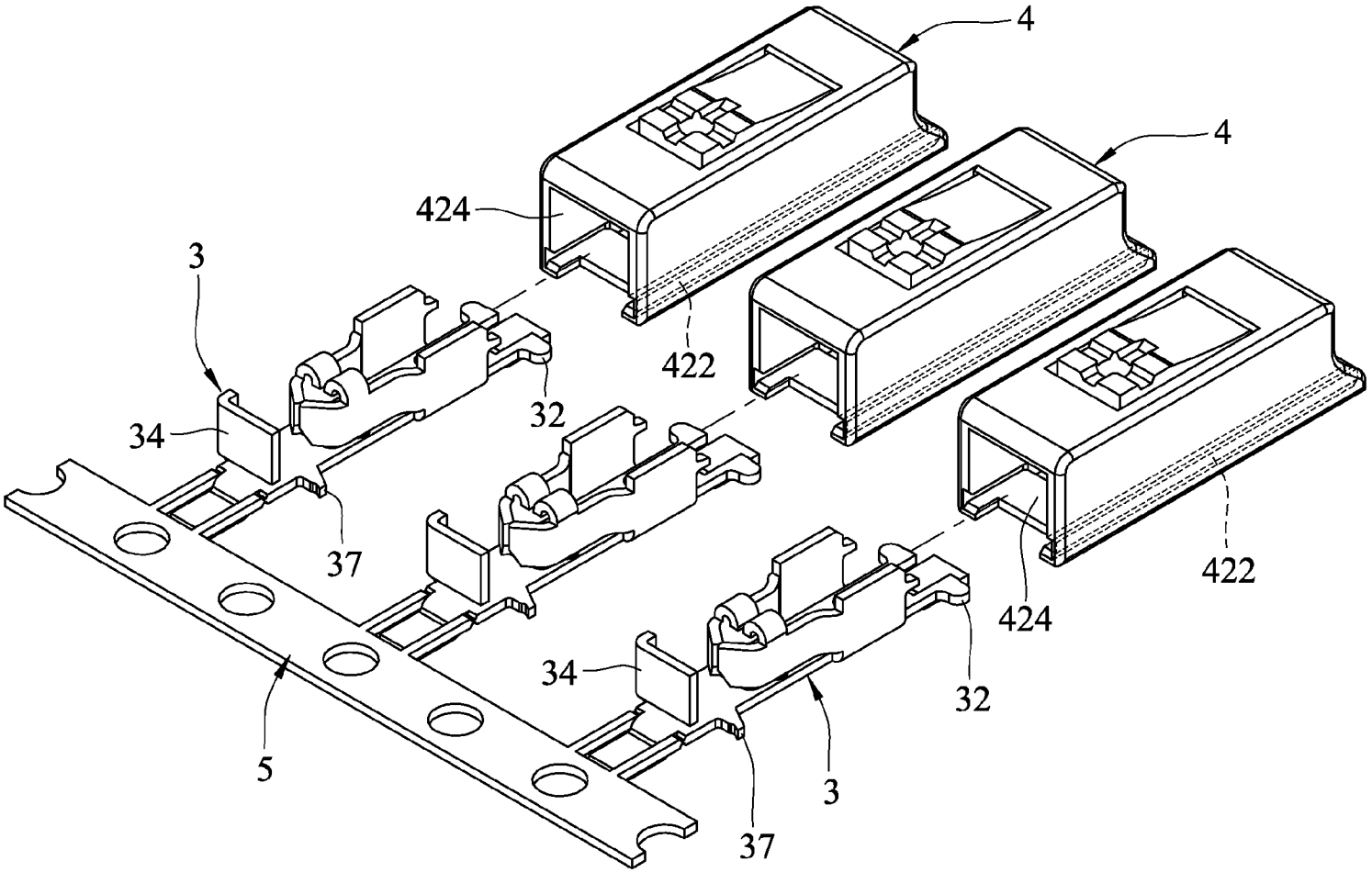
FIG. 11 is an exploded perspective view of the first embodiment illustrating a plurality of the terminal members being simultaneously assembled with a plurality of the insulative housings.

Referring to FIG. 11, it should be further noted that, a plurality of the terminal members 3 may be each connected to a linking member 5 at an end proximate to the stop plate 34 to expedite the assembly process. This is achieved by connecting a plurality of terminal members 3 to the linking member 5 and aligning them respectively with a plurality of insulative housings 4, then pushing the linking member 5 toward the insulative housings 4, relying on the fitting portions 422 of the insulative housings 4 to guide the guided parts 32 of the corresponding terminal members 3 and complete the assembly of multiple wire terminal connectors simultaneously. The linking member 5 is then removed from the terminal members 3. This convenience demonstrates the simplicity of the assembly process for this invention, making the invention well-suited for mass production.

Figure 12:
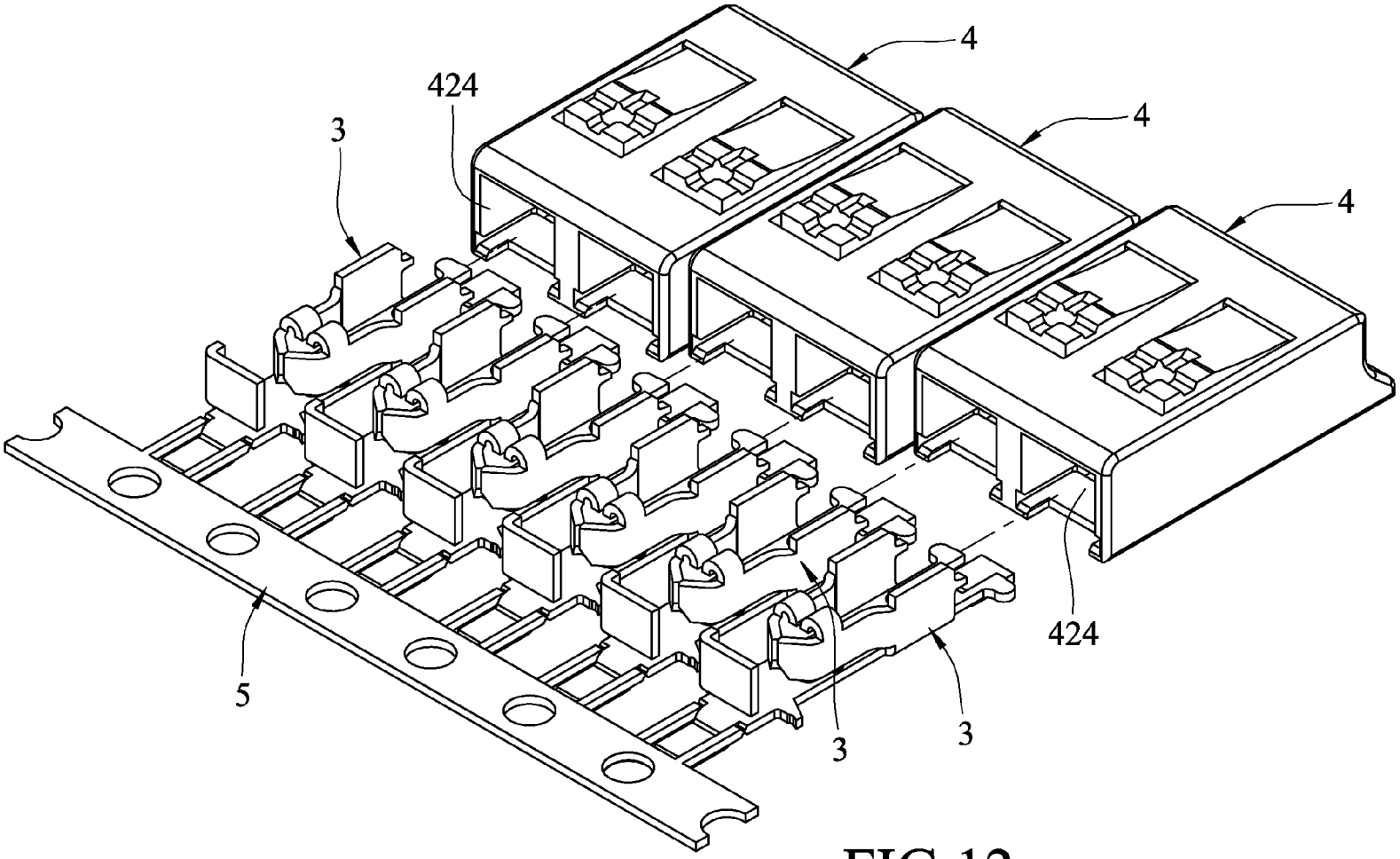
FIG. 12 is an exploded perspective view of a second embodiment of a wire terminal connecter according to the invention.

Referring to FIG. 12, a second embodiment of a wire terminal connector according to the present invention is essentially similar to the first embodiment, except that two insulative housings 4 of the first embodiment are connected together to be assembled respectively with two terminal members 3 to form the wire terminal connector. In this embodiment, a plurality of terminal members 3 are connected to a linking member 5 to be assembled with the respective one of the corresponding insulative housings 4. It should be noted that while the wire terminal connector of this embodiment is shown as having a pair of connected insulative housings 4 and a pair of corresponding terminal members 3, a user may connect three or more insulative housings 4 together to form the wire terminal connector according to practical requirements. In this way, not only does the second embodiment possess the advantages of the first embodiment, but it also provides another configuration of the wire terminal connector for users to adapt from.

In sum, the advantages of the present invention are summarized as follows:

(1) The clamping parts 331 of the clamp plates 33 allow the user to complete installation of the wire conductor 2 by simply inserting the wire conductor 2 into the wire terminal connector. In addition, the two resilient clamp plates 33 are capable of clamping wire conductors 2 of any size between 18 to 24 AWG, which gives the invention wider applicability.

(2) By pushing down on the tongue plate 44, the release parts 332 of the clamp plates 33 are forced apart, causing the clamping parts 331 to move away from the wire conductor 2 and thereby allowing the user to pull out the wire conductor 2 with ease.

(3) The stop face 34 of the terminal member 3 can prevent the wire conductor 2 from thrusting through the insulative housing 4 and causing danger.

(4) The simple assembly process of the present invention makes mass production thereof an easy and straight forward matter, requiring only a linking member 5 to connect the terminal members 3.

(5) The first and second panel protrusions 35, 36 increase the area of contact between the wire conductor 2 and the terminal member 3 and allow more heat to transfer from the wire conductor 2 to the terminal member 3 for dissipation through the hollow portion 423 of the insulative housing 4.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A wire terminal connector for connecting a wire conductor, comprising: a terminal member having a base panel, two resilient clamp plates that project from said base panel for clamping the wire conductor therebetween, and a stop plate that projects from said base panel and extends transversely of said clamp plates for abutting against one end of the wire conductor; an insulative housing having a receiving space, a first open end that permits said terminal member to enter and to be disposed in said receiving space, and a second open end that is opposite to said first open end and that is adapted for the wire conductor to enter said receiving space; and wherein each of said clamp plates has a clamping part for clamping the wire conductor, and a release part formed on said clamping part to enable said clamping part to move away from the wire conductor, said insulative housing further having a tongue plate that is operable to push said release part of each of said clamp plates and to thereby move said clamping part of each of said clamp plates away from the wire conductor.

2. The wire terminal connector as claimed in claim 1, wherein said clamping parts of said clamp plates respectively have clamping ends extending toward each other, and top ends opposite to said base panel, said release parts of said clamp plates being spaced apart from said clamping ends of said clamping parts and respectively formed on said top ends of said clamping parts and resiliently contacting each other, said tongue plate being disposed above said release parts and having a tongue protrusion that protrudes downwardly for pushing apart said release parts.

3. The wire terminal connector as claimed in claim 2, wherein said insulative housing further has a housing body defining said receiving space, said tongue plate having a fixed end that is fixed to said housing body, a free end that is opposite to said fixed end, and a force-application part that is connected to said free end oppositely of said fixed end, said tongue protrusion protruding downwardly from said force-application part, said tongue protrusion wedging between said release parts of said clamp plates when said force-application part is pressed downward.

4. The wire terminal connector as claimed in claim 3, wherein said release parts extend upwardly and respectively from said top ends of said clamping parts and bend archedly to extend toward and contact each other.

5. The wire terminal connector as claimed in claim 1, wherein said terminal member further has a first panel protrusion projecting from said base panel in proximity to said second open end for contacting the wire conductor.

6. The wire terminal connector as claimed in claim 1, wherein said insulative housing further has a guiding part disposed in said receiving space in proximity to said second open end for guiding the wire conductor to extend into said receiving space.

7. A wire terminal connector for connecting a wire conductor, comprising: a terminal member having a base panel, and two resilient clamp plates that project from said base panel for clamping the wire conductor therebetween, each of said clamp plates having a clamping part for clamping the wire conductor, and a release part that is formed on said clamping part to enable said clamping part to move away from the wire conductor; and an insulative housing having a receiving space, a tongue plate, a first open end that permits said terminal member to enter and to be disposed in said receiving space, and a second open end that is opposite to said first open end and that is adapted for the wire conductor to enter said receiving space, said tongue plate being proximal to said release part and being operable to push said release part of each of said clamp plates and to thereby move said clamping part of each of said clamp plates away from the wire conductor.

8. The wire terminal connector as claimed in claim 7, wherein said clamping parts of said clamp plates respectively have clamping ends extending toward each other, and top ends opposite to said base panel, said release parts of said clamp plates being spaced apart from said clamping ends of said clamping parts and respectively formed on said top ends of said clamping parts and resiliently contacting each other, said tongue plate being disposed above said release parts and having a tongue protrusion that protrudes downwardly for pushing apart said release parts.

9. The wire terminal connector as claimed in claim 8, wherein said insulative housing further has a housing body defining said receiving space, said tongue plate having a fixed end that is fixed to said housing body, a free end opposite to said fixed end, and a force-application part that is connected to said free end oppositely of said fixed end, said tongue protrusion protruding downwardly from said force-application part, said tongue protrusion wedging between said release parts of said clamp plates when said force-application part is pressed downward.

10. The wire terminal connector as claimed in claim 9, wherein said release parts extend upwardly and respectively from said top ends of said clamping parts and bend archedly to extend toward and contact each other, said tongue protrusion being extendable to a point where said release parts contact each other.

11. The wire terminal connector as claimed in claim 7, wherein said terminal member further has a stop plate projecting from said base panel and extending transversely of said clamping parts of said clamp plates for abutting against one end of the wire conductor.

12. The wire terminal connector as claimed in claim 7, wherein said terminal member further has a first panel protrusion projecting from said base panel in proximity to said second open end for contacting the wire conductor.

13. The wire terminal connector as claimed in claim 7, wherein said insulative housing further has a guiding part disposed in said receiving space in proximity to said second open end for guiding the wire conductor to extend into said receiving space.

* * * * *